US006416021B2

(12) United States Patent
Greene, Jr.

(10) Patent No.: US 6,416,021 B2
(45) Date of Patent: Jul. 9, 2002

(54) LOCOMOTIVE WHISTLE CONTROLLED RAILROAD GRADE CROSSING WARNING SYSTEM

(76) Inventor: George Jefferson Greene, Jr., 19970 Holly Hills Dr., LaRue, TX (US) 75770-9756

( * ) Notice: Subject to any disclaimer, the term of this patent is extended or adjusted under 35 U.S.C. 154(b) by 0 days.

(21) Appl. No.: 09/867,014

(22) Filed: May 29, 2001

Related U.S. Application Data

(60) Provisional application No. 60/207,979, filed on May 30, 2000.

(51) Int. Cl.[7] ..... B61L 29/32

(52) U.S. Cl. ..... 246/294; 246/125; 246/293; 246/473.1

(58) Field of Search ..... 246/130, 122 R, 246/125, 126, 293, 294, 295, 296, 124, 473.1; 340/901, 902, 903, 907, 904

(56) References Cited

U.S. PATENT DOCUMENTS

| | | | | | |
|---|---|---|---|---|---|
| 3,987,989 | A | | 10/1976 | Geiger | 246/34 R |
| 4,108,405 | A | | 8/1978 | Gibson | 246/125 |
| 4,365,777 | A | | 12/1982 | Geiger | 246/130 |
| 4,942,395 | A | | 7/1990 | Ferrari et al. | 340/907 |
| 5,265,831 | A | * | 11/1993 | Muller | 246/124 |
| 5,590,855 | A | | 1/1997 | Kato et al. | 246/202 |
| 5,713,540 | A | * | 2/1998 | Gerszberg et al. | 246/121 |
| 5,729,213 | A | | 3/1998 | Ferrari et al. | 340/901 |
| 5,735,492 | A | * | 4/1998 | Pace | 246/125 |
| 5,868,360 | A | | 2/1999 | Bader et al. | 246/202 |
| 5,890,682 | A | | 4/1999 | Welk | 246/125 |
| 5,954,299 | A | | 9/1999 | Pace | 246/293 |
| 6,035,567 | A | * | 3/2000 | Cameron | 40/606 |
| 6,157,322 | A | * | 12/2000 | Anderson | 246/293 |
| 6,259,375 | B1 | * | 7/2001 | Andras | 340/907 |

* cited by examiner

*Primary Examiner*—S. Joseph Morano
*Assistant Examiner*—Frantz F. Jules
(74) *Attorney, Agent, or Firm*—C. W. Alworth

(57) ABSTRACT

A railroad grade crossing warning device designed to operate at un-guarded grade crossings without the need for expensive train detection sensors. The system utilizes the sound of an approaching locomotive horn or whistle to activate a warning at a grade crossing. The preferred device is self contained and is powered by solar panel and storage battery to provide a flashing strobe warning on the approach of a train.

20 Claims, 4 Drawing Sheets

LOCOMOTIVE WHISTLE CONTROLLED RAILROAD GRADE CROSSING WARNING SYSTEM

This application claims the benefit of U.S. Provisional Application No. 60/207,979 filed on May 30, 2000.

The present invention relates generally to safety devices and in particular to an apparatus for warning the motorist of approaching trains at Railroad Grade Crossings.

BACKGROUND OF THE INVENTION

The inventor has worked in the field of safety in the workplace for some twenty-five years and has performed considerable work on studies dealing with railroad grade crossing accidents. Motorist-train accidents occur at railroad grade crossings for two reasons. First and foremost, a motorist is attempting to "beat" a train to the crossing, which generally results in an impact between the train and the automobile. These accidents will occur at both guarded and un-guarded crossings. The second cause of grade crossing accidents is due to the fact that the motorist does not see the approaching train. Finally, grade crossing accidents occur because the motorist did not hear the approaching train.

Very few accidents at guarded crossing result from the fact that the motorist did not see or hear the approaching train. These forms of accident occur at un-guarded crossing. State law requires that, at un-guarded crossing, the motorist come to a complete stop at the grade and look both ways before proceeding across the tracks. What the law requires and what the motorist does are two different things. Most motorists approach the tracks, take a quick look (or attempt to listen), and then drive across the tracks. Some of these grade crossings occur at a bend in the railroad, which makes it impossible to see a train in time—particularly if the vehicle is still moving forward.

In analyzing railroad grade crossings, it has been found that the elderly are particularly susceptible. Their vision and hearing is impaired. It was further found that the modern car is basically soundproof Add to this fact, that most motorists run a ventilation system and a radio. (This fact has been noted in equipping emergency vehicles with sirens and horn-type warning systems, which are designed to penetrate the sound insulation of the modern vehicle.)

It is known that there are well over 100,000 un-guarded railroad crossings in the United States alone. Over one-half of these crossings are "private" crossings. That is, a public road is not involved. The cost off equipping the average grade crossing with conventional warning systems is approximately 50,000 dollars per crossing. Whereas, the state could require all public roads to be guarded; no such requirement can be placed on private crossings. Due to the fact that the railroad has the right-of-way, the states must pay for guarded crossings from state funds. Guarded crossings require a source of power that is supplied by local electric utilities or by railroad power systems.

Thus, there remains a need for an inexpensive warning system that may be placed at critical un-guarded crossings throughout the United States. The system should be capable of being "self-powered."

PRIOR ART

All of the prior art requires some sort of train movement detection system. One of the systems ties to the railroad tracks and others require some form of transmitter attached to the train. These systems are, by their very nature, expensive. Gibson (U.S. Pat. No. 4,108,405) discloses a light assembly and flasher circuit, which may readily be installed at grade crossings. The device uses a battery, solar cells or conventional battery charger to charge the battery, and warning lights, strobes and bells, all mounted in a stand. However, train detection requires electrical connection to the railroad track several hundreds of yards to each side of the crossing along with associated cables.

Pace (U.S. Pat. Nos. 5,735,492 and 5,954,299) discloses a Railroad Traffic Warning System Apparatus and Method Therefore, which is similar to the system disclosed by Gibson. However, the system proposed by Pace utilizes magnetic sensors located near the track to detect the train. Again, train detection requires sensors and cabling located several hundreds of yards to each side of the grade crossing.

Kato (U.S. Pat. No. 5,590,855) discloses a Train Detection Device for Railroad Models, etc. which may be applied to full sized trains. The train detection method utilizes the capacitance effect caused by a passing train. Again, cables and detectors must be placed several hundreds of yards to each side of the grade crossing.

Bader (U.S. Pat. No. 5,868,360) discloses a Vehicle Presence Detection System, which utilizes magnetic effects (voltage) caused by a passing train. In this system a series of coils are placed in the railroad bed several hundreds of yards to each side of the grade crossing. Again, cables and detectors must be placed several hundreds of yards to each side of the grade crossing.

Welk (U.S. Pat. No. 5,890,682) proposes a system that utilizes GPS (Global Positioning System) and RF (Radio Frequency) transmission. The GPS is mounted in the train along with a computer, which knows the location of all grade crossings, and the train. As the train approaches a given crossing, an RF signal is transmitted to the crossing system to activate the warning system. This concept will require an expensive RF receiver in each locomotive, which is not cost effective.

In a similar manner, Ferrari et al. (U.S. Pat. Nos. 4,942,395 and 5,729,213) proposes an RF system that transmits a continuous signal. The signal would be picked up by the crossing guard system to activate the warning system. At the same time, it is proposed that vehicles also be equipped with RF warning systems. The concept is not cost effective, as each vehicle (in the country) must have a receiver system. Government could require new vehicles to have the system, but is would be impossible to retrofit existing vehicles.

Geiger (U.S. Pat. Nos. 3,987,989 and 4,365,777) proposes an electronic audio detection system, which attaches to the rails and "listens" for the approaching train. Steel rails readily transmit audio waves and the rolling noise of an approaching train is easily detected. This is then sent to the crossing guard warning system. Again, cables and detectors must be placed several hundreds of yards to each side of the grade crossing.

The prior art is well developed and it works. However, it requires expensive installations. Installing sensors at grade crossings and running cabling for several hundreds of yards to each side of the crossing takes time and money. Installing RF transmitters in each locomotive is cost prohibitive. Thus, there remains the need for a stand-alone grade crossing warning system, which negates the need for expensive installations, which can provide a visual warning, and which can readily be installed at the thousands of un-guarded grade crossings through out the county.

SUMMARY OF THE INVENTION

The instant invention is designed to operate at un-guarded grade crossings without the need for expensive train detection sensors. It comprises of a self-contained, stand-alone, device, which is to be installed on each side of an un-guarded crossing. The stand-lone device contains a battery, a charging source, a flashing warning light, and a sign, which is designed to inform the motorist as to the function of the device, and a device to detect the presence of an approaching train. The important difference in the system, and to the prior art, is the train detection method.

State law requires an approaching train to blow its horn, or whistle, a predetermined number of times and distance from the unguarded crossing. A well-educated train-driver knows the location of all grade crossings on the line. In addition, the railroad company installs "W" or whistle signs at the proper distance, either side, of all crossings whenever and wherever required. Thus, the locomotive horn itself severs to announce the presence of a train and recognition of the blowing horn, by the instant device, will serve as the train detector.

Mounted to the system is directional detector, which is tuned to the standard audio frequency, used by locomotives. The audio detector points in both directions and uses a tube to mechanically direct the horn signal to a microphone or its equivalent. The microphone is coupled to the appropriate electronic amplifier/filter, which is tuned to the locomotive horn frequency (or frequencies). The amplifier/filter in turn energizes the warning system whenever a train is detected.

In the preferred mode, the instant invention utilizes a solar panel to keep the battery charged. The battery provides power for the amplifier/filter, logic circuits, and the warning signal that is usually a strobe light. The apparatus also includes a large sign which essentially states "Danger High Speed Trains: Look and Listen Before Crossing: Flashing Light Indicates Train Is Approaching" The actual language would be set by state law or follow the recommendations of various railroad standards.

DETAILED DESCRIPTION OF THE EMBODIMENT

Figure 1:
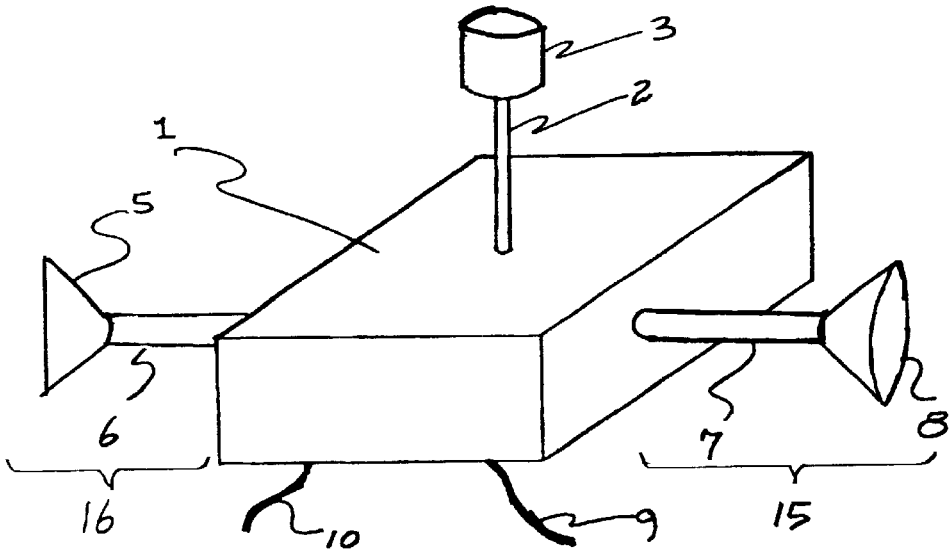
FIG. 1 shows the instant device mounted in a weatherproof cabinet with an external strobe light and locomotive horn detectors.
Figure 3:
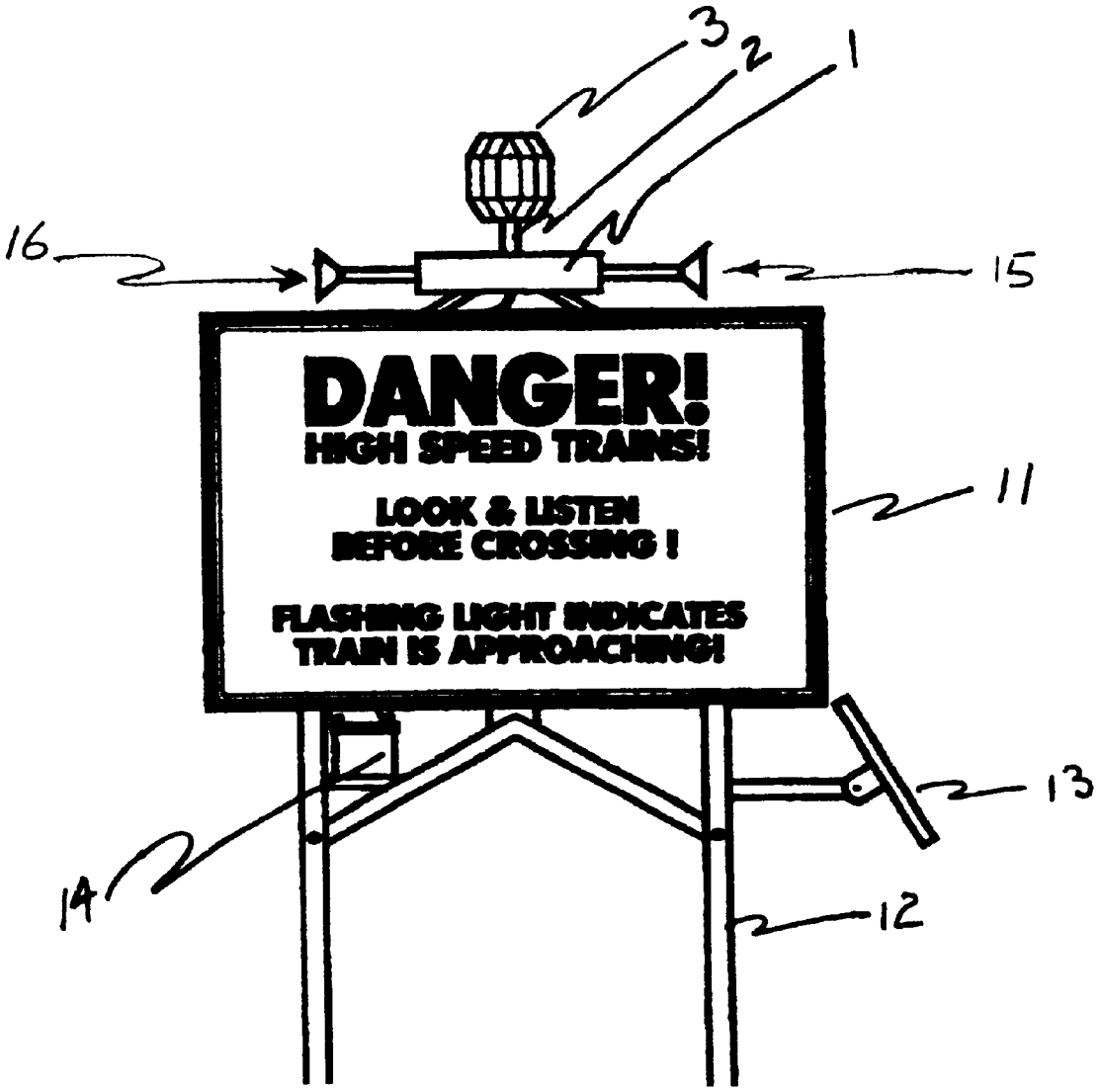
FIG. 3 shows the instant device including the sign, a storage battery, the preferred charging device, the strobe light and horn detectors.

Referring to FIGS. 1 and 3, the preferred device consists of an appropriate stand, 12, upon which is mounted a battery, 14, a solar panel, 13, a flashing beacon (strobe), 3, directional locomotive horn detectors, 15 and 16, and a weatherproof cabinet, 1. If standard electric power is available, a battery charger (not shown) may be used to maintain the energy level in the battery. A battery system is still preferred in case electric power is lost due to storms or other problems. The strobe, 3, may be extended above the cabinet by an extension conduit, 2, if required.

The location of the various components within the system is not critical and would be set by design requirements. For example, the solar panel must be located in a manner that would protect it from vandalism and/or attack by bullets and the like. In a similar manner the beacon (or strobe), 3, must be protected. Electronics and control logic should be encased in the protective enclosure, 1. The battery should be enclosed and protected.

The horn sound detector (15 and 16) comprises a hollow tube, 6 and 7, that points in the direction from which trains would approach. These horns provide an audio signal related to the locomotive horn or whistle to the electronic circuits. Additionally the hollow tube is flared, 5 and 8, at the end pointing in the direction from which trains approach. Usually, trains travel in both directions; thus, two horn sound detectors pointing in two directions will generally be required.

Figure 2:
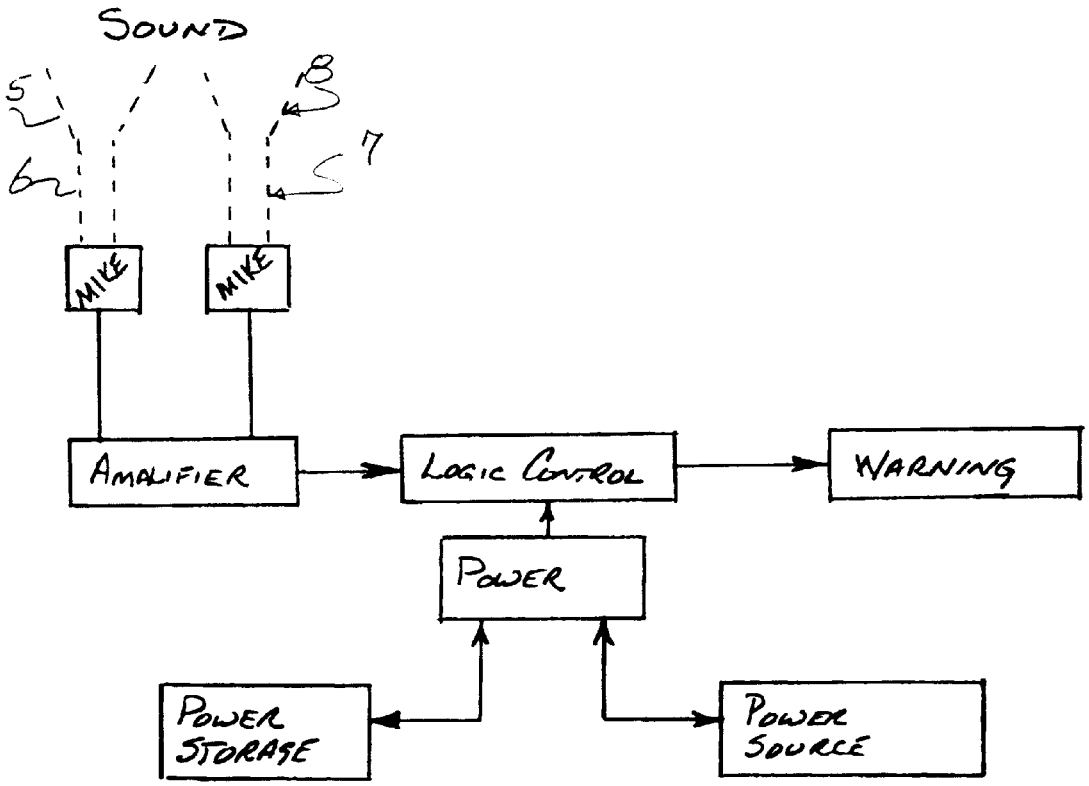
FIG. 2 shows a control block diagram for the instant device.

As shown in FIG. 2, sound is then focused on a microphone (or equivalent) that is attached to the filter/amplifier. The electronic filter/amplifier is tuned to the horn frequency or frequencies used on locomotives. The amplifier is also set to trip at a certain sound level (or intensity) measured in decibels (dB). For example, the average locomotive horn is 185 dB, which falls off as the square of the distance from the horn. Thus, the amplifier would be set to trip at 100 d B and at the horn frequency, which would reduce the number of false alarms possibly caused by other horn sounds near the grade crossing. This electronic signal would be passed to the logic circuit. It should be noted that the amplifier/filter and control logic circuits would (or could) be combined on the same board. In fact it is not necessary to separate the two electronic systems. This disclosure contemplates the combination of these circuits in function and form.

Standard electronic design techniques would be employed to obtain a filter/amplifier that would respond to locomotive horns at adjustable frequencies and levels. The output of the filter/amplifier would be sent to a logic controller for activation of the warning sub-system. All functions may be combined within one circuit.

The logic control circuit would also provide regulation of power. That is, the circuit would receive energy from the solar panel, or other source of energy, and control charging of the battery. Additionally, the control circuit would distribute power to the filter/amplifier and warning sub-system. In the preferred device, the logic control circuit would control power developed by a solar panel and stored in a battery, and the warning sub-system would be a strobe. Alternate embodiments would be capable of receiving power from power lines (110 volts or equivalent) and charging the storage battery. State Law may set the warning sub-system, and a strobe might not be legal. The device contemplates this situation, and the warning sub-system may take the form of standard railroad crossing guards such as bells, flashing lights, crossing gates, and the like, provided some form of external power is available.

Other alternate embodiments envision the separation of the weatherproof housing from the horn detectors, logic control and power source. For example, the railroad may choose to place the signs and warning sub-system separate from the horn detection, amplifier/filter, control logic and power source. These components may have to be placed in a vandal-proof building or the like depending on the location.

Figure 4:
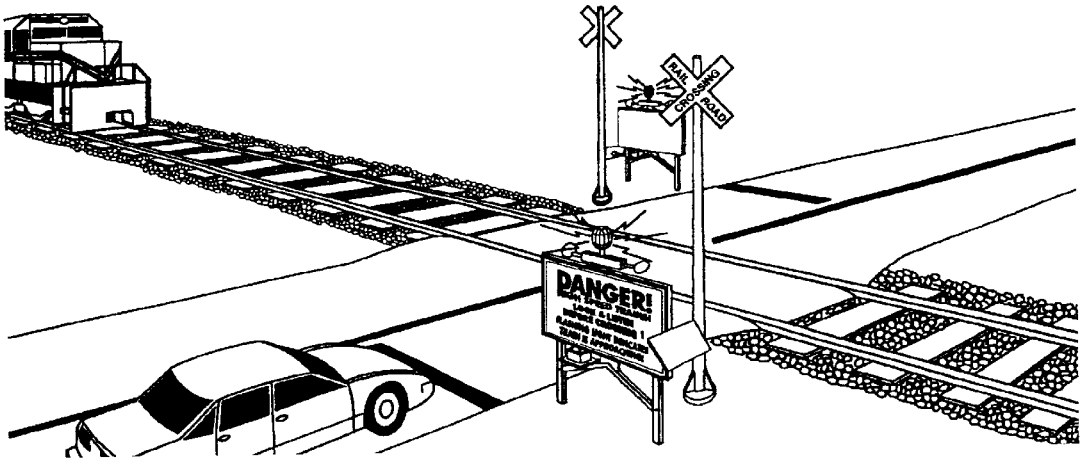
FIG. 4 shows a common installation of the instant device on both sides of the grade crossing.

At a minimum, two such preferred systems should be installed on either side of the grade crossing as shown in FIG. 4. This concept provides safety as a redundant system. In some circumstances more than one road approaches a grade crossing. Under these circumstance a warning system should be installed on each approach to the grade crossing.

There has been disclosed the preferred and best modes for the instant invention. Several alternate embodiments contemplating other forms of warning sub-systems and separation of components within the instant device have also been disclosed. The instant device is essentially a stand-alone device that may drive any form of external warning, and the use of the instant device in this situation is a part of the disclosure.

I claim:

1. A locomotive whistle controlled railroad grade crossing warning system for warning of the approach of a train powered by a locomotive having a whistle by sensing the sound of the approaching locomotive whistle comprising:

horn detection means providing a signal indicating the presence of the sound of the approaching locomotive whistle;

control logic means providing means for receiving signal from said horn detection means;

warning means for reacting to said logic control means to provide indication of the presence of a locomotive; and power source means for powering said horn detection means and said control logic means.

2. The device of claim 1 wherein said horn detection means further comprises directional horn detector and amplifier/filter.

3. The device of claim 2 further comprising a weatherproof housing having an outside and an inside.

4. The device of claim 3 wherein said horn detection means is mounted to the outside of said housing and wherein said logic control means and said amplifier/filter are mounted inside of said housing.

5. The device of claim 4 wherein said power source further provides power to said warning means.

6. The device of claim 5 wherein said warning means comprises a strobe.

7. The device of claim 6 wherein said power source further comprises a storage battery and means for charging said storage battery.

8. The device of claim 7 wherein said means for charging said storage battery comprises a solar panel.

9. The device of claim 8 further mounted to a stand for placement by a railroad grade crossing.

10. The device of claim 1 wherein said power source further provides power to said warning means and said power source receives power from alternating current source.

11. The device of claim 1 wherein said power source further provides power to said warning means and said power source receives power from railroad provided power source.

12. The device of claim 1 wherein said warning means comprises standard railroad crossing guard means.

13. A locomotive whistle controlled railroad grade crossing warning system for warning of the approach of a train powered by a locomotive having a whistle by sensing the sound of the approaching locomotive whistle comprising:

a weatherproof housing having an inside and an outside;

plurality of directional horn detectors mounted to said outside of said housing each providing an audio signal derived from the sound of the approaching locomotive whistle;

amplifier/filter within said housing capable of receiving said audio signal and providing an electronic signal indicating the presence of the sound of the approaching locomotive whistle;

control logic means within said housing providing means for processing said electronic signal;

warning means for reacting to said logic control means to provide indication of the presence of a locomotive; and power source means for powering said horn detection means and said control logic means.

14. The device of claim 13 wherein said power source further provides power to said warning means.

15. The device of claim 14 wherein said warning means comprises a strobe.

16. The device of claim 15 wherein said power source further comprises a storage battery and means for charging said storage battery.

17. The device of claim 16 wherein said means for charging said storage battery comprises a solar panel.

18. The device of claim 17 further mounted to a stand for placement by a railroad grade crossing.

19. A locomotive whistle controlled railroad grade crossing warning system for warning of the approach of a train powered by a locomotive having a whistle by sensing the sound of the approaching locomotive whistle comprising:

a weatherproof housing having an inside and an outside;

plurality of directional horn detectors mounted to said outside of said housing each providing an electronic audio signal derived from the sound of the approaching locomotive whistle;

amplifier/filter within said housing capable of receiving said audio signal and providing an electronic signal indicating the presence of the sound of the approaching locomotive whistle;

control logic means within said housing providing means for processing said electronic signal;

strobe warning means for reacting to said logic control means to provide indication of the presence of a locomotive;

storage battery for providing power to said strobe warning means, said amplifier/filter means, said control logic means, and said directional horn detectors, and solar panel for charging said storage battery.

20. The device of claim 18 further mounted to a stand for placement by a railroad grade crossing.

* * * * *